US009426868B2

(12) United States Patent
Dau

(10) Patent No.: US 9,426,868 B2
(45) Date of Patent: Aug. 23, 2016

(54) COMMISSIONING LED (LIGHT EMITTING DIODE) LIGHTING SYSTEM AND METHOD OF ASSEMBLING SAME

(71) Applicant: Hai Dau, San Ramon, CA (US)

(72) Inventor: Hai Dau, San Ramon, CA (US)

( * ) Notice: Subject to any disclaimer, the term of this patent is extended or adjusted under 35 U.S.C. 154(b) by 0 days.

(21) Appl. No.: 14/270,441

(22) Filed: May 6, 2014

(65) Prior Publication Data

US 2015/0327348 A1 Nov. 12, 2015

(51) Int. Cl.
*H05B 37/02* (2006.01)
*H05B 33/08* (2006.01)

(52) U.S. Cl.
CPC ..... *H05B 37/0272* (2013.01); *H05B 33/0845* (2013.01); *H05B 33/0854* (2013.01); *H05B 33/0884* (2013.01)

(58) Field of Classification Search
USPC ..... 700/2, 11, 19, 20, 23; 307/38, 39; 315/149, 152, 153
See application file for complete search history.

(56) References Cited

U.S. PATENT DOCUMENTS 8,981,913 B2 * 3/2015 Henig et al. ..... 340/12.5
2012/0271477 A1 * 10/2012 Okubo et al. ..... 700/297
2015/0008828 A1 * 1/2015 Carrigan et al. ..... 315/131

* cited by examiner

*Primary Examiner* — Thuy Vinh Tran
(74) *Attorney, Agent, or Firm* — Mark Gonzales

(57) ABSTRACT

In one embodiment, the present invention includes a commissioning lighting system. The lighting system comprises a plurality of light emitting diode (LED) lighting elements, and a plurality of radio frequency (RF) enabled Ethernet power driver devices. The RF enabled Ethernet power driver devices are coupled to provide power to the plurality of LED lighting elements through Ethernet cables. Each power driver device of the plurality of RF enabled Ethernet power driver devices uses integrated firmware to form a network allowing each power driver device to be selectively programmed to control corresponding LED lighting elements.

20 Claims, 5 Drawing Sheets

COMMISSIONING LED (LIGHT EMITTING DIODE) LIGHTING SYSTEM AND METHOD OF ASSEMBLING SAME

CROSS REFERENCE TO RELATED APPLICATIONS

Not applicable.

BACKGROUND

The present invention relates to lighting systems, and in particular, to commissioning LED lighting systems and methods of assembling same.

EIA estimates that in 2011, about 461 billion kilowatt-hours (kWh) of electricity were used for lighting by the residential and commercial sectors. Lighting costs society billions of dollars every year to produce electricity. Large energy production increases the use of fossil fuels and pollution from $CO_2$ emissions, and places a burden on the public sector to provide extended sources of energy production.

Florescent lighting has been used to reduce energy use. Florescent lighting requires heavy ballasts and expensive tubes in order to provide the cost savings from reduced energy use. In new construction, each light fixture requires electricians to drop an alternating current (AC) line for each light fixture thereby increasing the cost of installation. In many instances these lighting systems are controlled by motion sensors and crude timers which interrupt work during off hours. In many circumstances, these systems are overridden in order to continue activity which reduces the effectiveness of the system to save energy. Therefore, there is a need for power saving lighting systems which may be economically installed by laymen.

SUMMARY

Embodiments of the present invention include a lighting system.

Embodiments of the present invention include a.

The following detailed description and accompanying drawings provide a better understanding of the nature and advantages of the present invention.

DETAILED DESCRIPTION

Described herein are techniques for commissioning lighting systems and method of assembling same. In the following description, for purposes of explanation, numerous examples and specific details are set forth in order to provide a thorough understanding of the present invention. It will be evident, however, to one skilled in the art that the present invention as defined by the claims may include some or all of the features in these examples alone or in combination with other features described below, and may further include modifications and equivalents of the features and concepts described herein.

Figure 1:
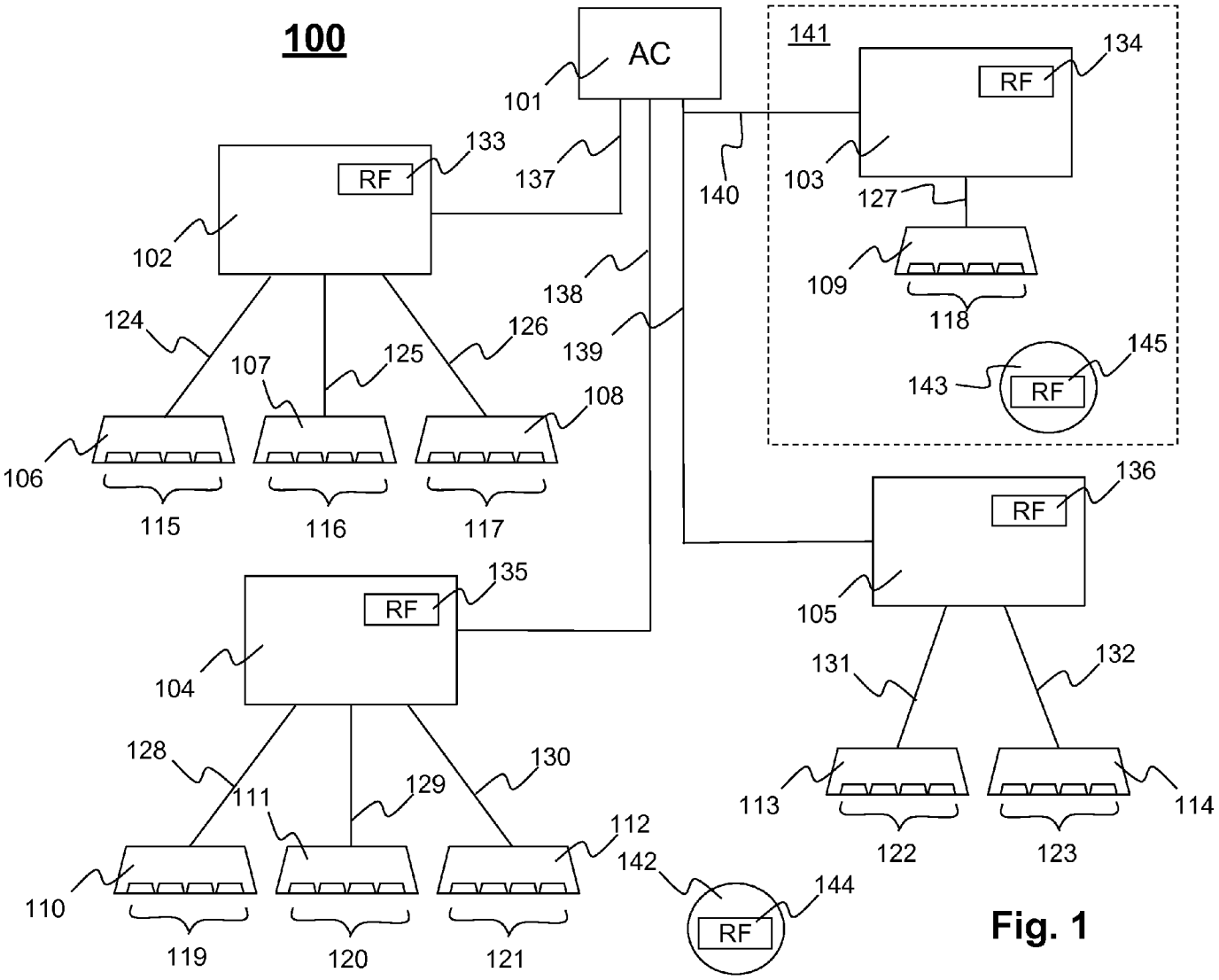
FIGS. 1 illustrates a lighting system according to one embodiment of the invention.

FIGS. 1 illustrates a lighting system 100 according to one embodiment of the invention. Lighting system 100 includes a plurality of LED lighting elements 115-123 and a plurality of RF enabled Ethernet power driver devices 102-105. Alternating current (AC) source 101 provided power to RF enabled Ethernet power driver devices 102-105. RF enabled Ethernet power driver devices 102 and 104 may require individual AC line drops 137-138 in order fulfill the power requirement. Alternately, RF enabled Ethernet power driver devices 103 and 105 may have less lighting elements (e.g. LED lighting elements 118, 122-123) and may therefore be able to share the same AC line 139-140.

Plurality of RF enabled Ethernet power driver devices 102-105 are coupled to provide power to the plurality of LED lighting elements 115-123 through Ethernet cables 124-132. Ethernet cables 124-132 may be coupled to fixtures 106-114 in order to power LED lighting elements 115-123, respectively. Plurality of RF enabled Ethernet power driver devices 102-105 may set DC currents on their output channels. No Ethernet data signals may pass to or from these devices.

Each power driver device of the plurality of RF enabled Ethernet power driver devices 102-105 has an associated RF module (e.g. RF modules 133-136) which enables the plurality of RF enabled Ethernet power driver devices 102-105 to form a network. Each power driver device of the plurality of RF enabled Ethernet power driver devices may use integrated firmware to form the network. The network may be an entirely wireless network such as a mesh network. With the network each Ethernet power driver device (e.g. RF enabled Ethernet power driver device 102) may be selectively programmed to control corresponding LED lighting elements (e.g. LED lighting element 115-117).

Each RF enabled Ethernet driver device (e.g. RF enable Ethernet driver device 103) may drive each channel of an associated Ethernet cable (e.g. Ethernet cable 128) to drive as many as four LED lighting elements (e.g. LED lighting elements 119). For example, lighting fixture 110 may fan out each pair of the Ethernet connection to a single LED lighting element of LED lighting elements 119.

Lighting system 100 may further comprise a plurality of RF enabled sensor modules 142-143 which form additional nodes in the network, wherein each RF enabled sensor modules (e.g. RF enabled sensor modules 144-145) provides information regarding its proximate physical zone. For example, RF enabled sensor module 144 may relay information to RF enabled Ethernet driver devices 102, 104, and 105 via the network. However, RF enabled sensor module 145 may be located in an enclosed area 141 such that RF enabled sensor module 143 relays information to RF enable Ethernet driver device 103 via the network.

The plurality of RF enable sensor modules 142-143 may relay a wide variety of information regarding the proximate location. For example RF enabled sensor module 142 may relay light intensity information, and RF enabled sensor module 143 may relay light intensity information as well as information regarding physical human activity. In this example, RF enabled sensor module 143 may have more than one sensor in order to operate.

Figure 2:
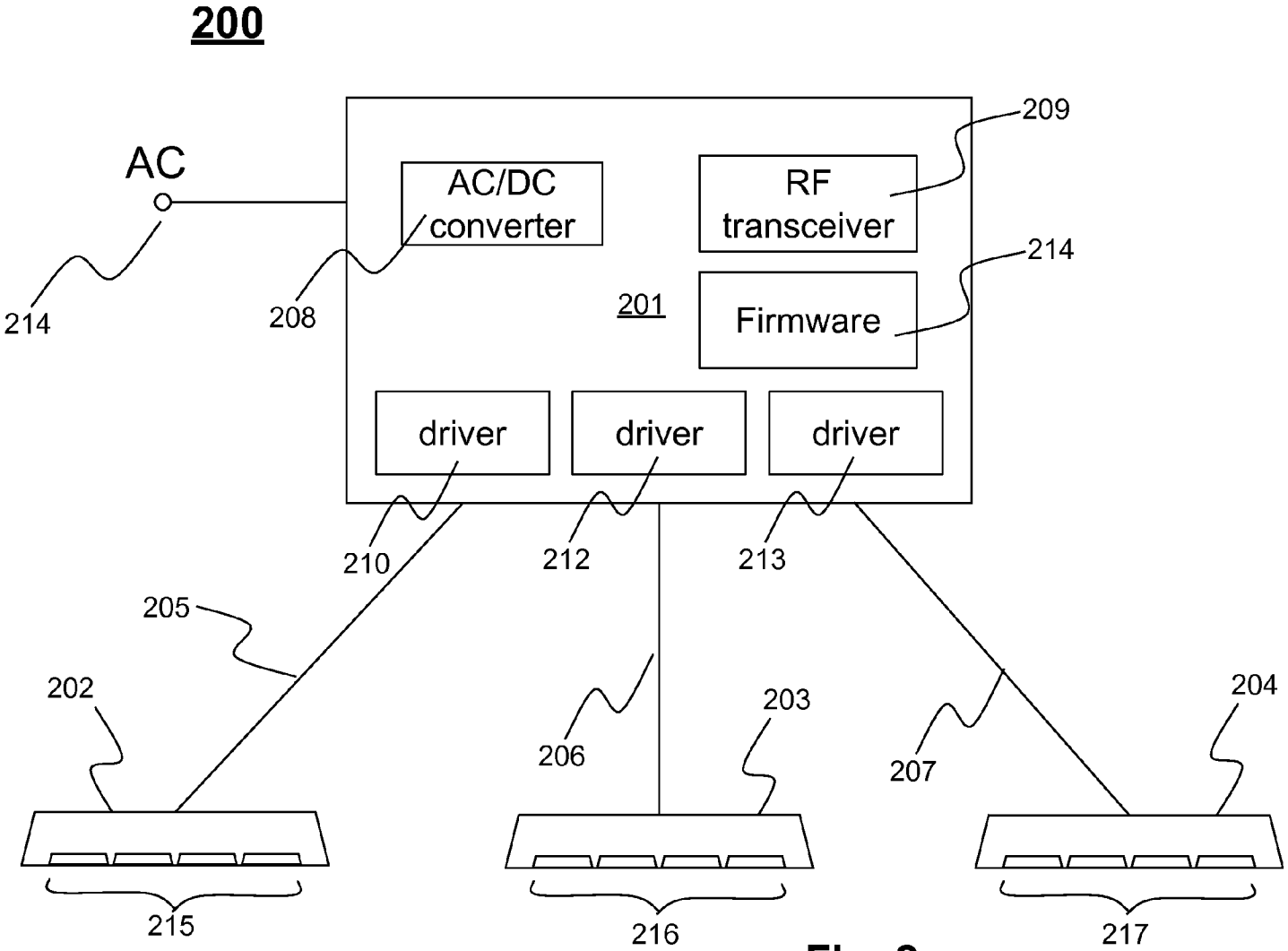
FIGS. 2 illustrates a portion of a lighting system according to another embodiment of the invention.

FIGS. 2 illustrates a portion of a lighting system 200 according to another embodiment of the invention. Portion 200 includes RF enabled Ethernet driver device 201 coupled to provide power to lighting fixtures 202-204. Lighting fixtures 202-204 each have a set of LED lighting elements 215-217. RF enabled Ethernet driver device 201 receives power through AC line 214. RF enabled Ethernet driver device 201 includes drivers 210-213, power converter 208, RF transceiver 209, and firmware 214.

Drivers 210-213 may provide variable power to LED lighting elements 215-216. The variable power may be controlled via commands sent to RF transceiver 209. In one embodiment, RF transceiver receives information regarding light intensity or human activity and firmware 214 determines the amount to drive particular channels to change the light intensity. The individual channels may be related to a predetermined configuration related to a commissioning of RF enabled Ethernet driver device 201. Firmware 214 may have memory to store the configuration.

Figure 3:
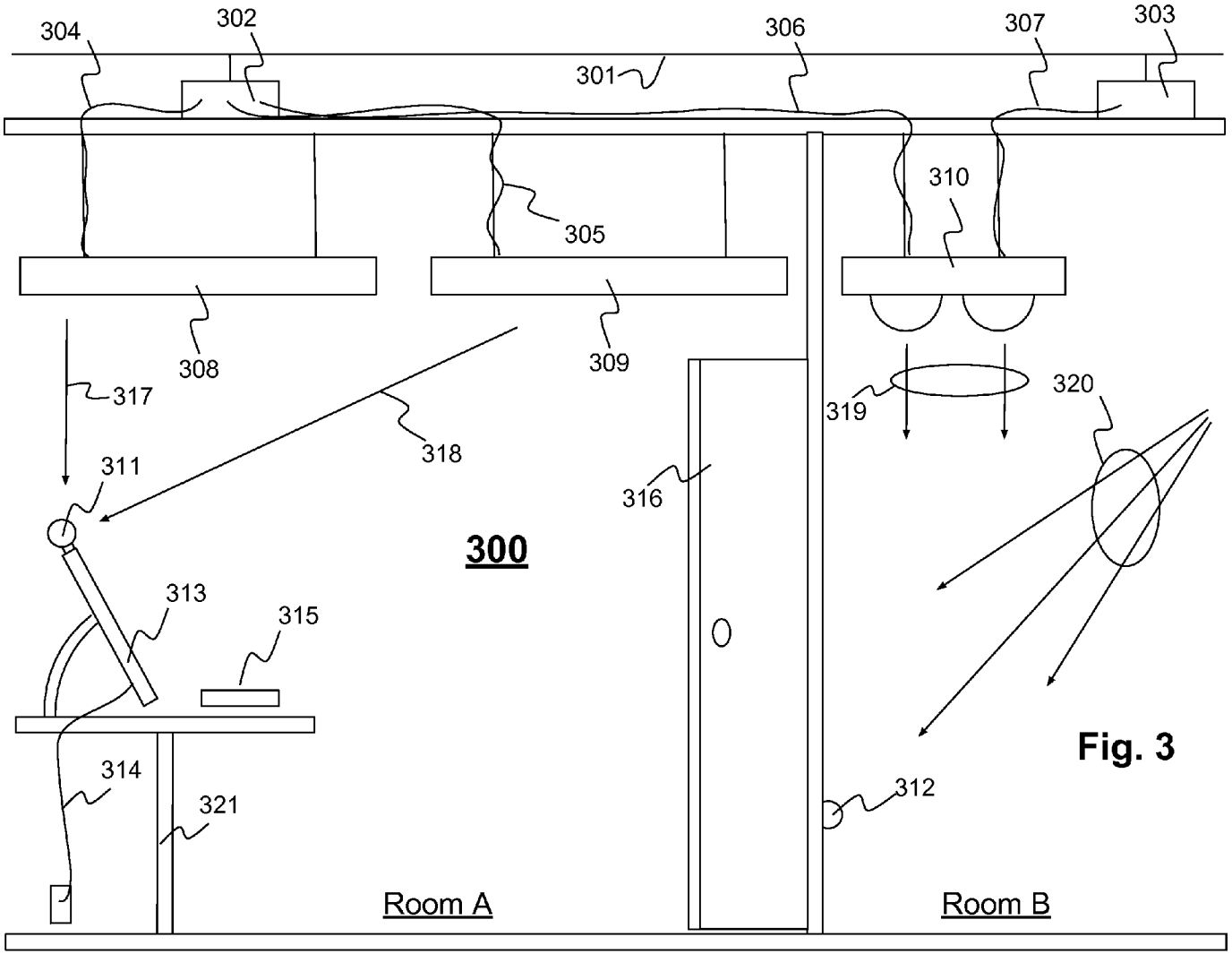
FIGS. 3 illustrates a lighting system according to yet another embodiment of the invention.

FIGS. 3 illustrates a lighting system 300 according to yet another embodiment of the invention. Lighting system 300 includes RF enabled driver devices 302-303, LED lighting fixtures 308-310, Ethernet cables 304-307, and RF enabled sensor modules 311-312. Lighting system 300 may be a commissioning system which allows the network of RF enabled devices to be configured. Computer 313 coupled to the internet via Ethernet cable 314 may also be part of lighting system 300.

RF enabled driver devices 302-303 are coupled to receive power from AC line 301. RF enabled driver device 302 is coupled to provide power to LED lighting elements within LED lighting fixtures 308-310. RF enabled driver device 303 is coupled to provide power to the other LED lighting elements within LED lighting fixtures 310. In this embodiment distribution and wiring of the Ethernet connections need not be orchestrated. For example, lighting fixture 310 is a different from light fixture 308-309 and receives two Ethernet cables and these cables may not need to come from the same RF enabled Ethernet driver device. Maybe LED lighting fixture is a long fixture extending into the FIG. 3 (i.e. not fully shown) and requiring more power.

RF enabled sensor module 311 may be coupled to a universal serial bus (USB) port on computer 313. This connection may serve solely to provide power to RF enabled sensor module 311 or may interface to computer 313 to provide remote control via the internet. Computer 313 may provide stored mapping and configurations associated with the network of RF enabled devices (e.g. RF enabled Ethernet drivers 302-303 and RF enabled sensor modules 311-312).

RF enabled sensor module 311 may have dual light sensors which sense light intensity from directions 317-318. Light intensity from direction 317 may be configured to a greater level than light intensity from direction 318 to provide sufficient light to the top of desk 321 and reduce light glare on a screen of computer 313. In this configuration, RF enabled sensor module may feedback light intensity information to RF enabled Ethernet driver module 302 to make the light from light fixture 308 brighter than the light from light fixture 309. The LED light elements within light fixture 309 may be simply dimmed or turned off according to this light intensity information and firmware associated with RF enabled Ethernet driver device 302.

In one embodiment, RF enabled sensor module 311 may receive Bluetooth signals from keyboard 315 which indicate a level of human activity which the system senses and may interpret to sustain the lighting in Room A. In another embodiment, RF enabled sensor module 311 may receive information regarding human activity via the USB port. In yet another embodiment, a sensor within an RF enabled sensor module (not shown) may receive information regarding a human sitting in a seat (not shown) and relay that information to RF enabled Ethernet driver device 302 to keep the LED lighting elements associated with Room A energized.

In one embodiment, RF enabled sensor module 311 may have a delay associated with sending a change in information. For example, door 316 may be suddenly opened effecting light sensed from direction 318. A light change may be delayed to prevent light control from being sporadically changed. If door 316 is left open light intensity from fixtures 308-309 may be adjusted. In another embodiment, that adjustment may be changed over more than one second to give a gradual change in configuration.

Room B may be a hallway with external sunlight 320 coming in through a window (not shown). In one embodiment, RF enabled sensor module 312 may relay light intensity information to RF enabled Ethernet driver devices 302-303 to decrease drive sent to LED lighting fixture 310 in order to maintain minimal safe light and thereby save energy. In another embodiment RF enabled sensor module 312 may have a motion sensor which when no motion is sensed for more than 10 minutes, RF enabled Ethernet drivers 302-303 may turn off the light provided by light fixture 310 or maybe simply dim the intensity to save energy. In yet another embodiment, a hallway or other location may have a plurality of RF enabled sensor modules which relay information to RF enabled Ethernet driver modules (not shown) This information may be used as history which may anticipate a person's path and in response illuminate that path. The history may be real time or may find patterns over time.

In another embodiment, software enabled by RF enabled computer 313 may potentially commission each channel of each RF enabled Ethernet power drivers 302-303 to a corresponding set of sensors. In yet another embodiment, the commissioning includes sensor feedback routines which examine which sensors respond to which LED lighting elements of lighting fixtures 308-310.

In one embodiment, the RF enabled computeris a portable device (not shown) and the software includes routines to commission each channel by registering a configuration of proximate RF enabled devices of the network and allowing a user to validate and/or alter the configuration.

Figure 4:
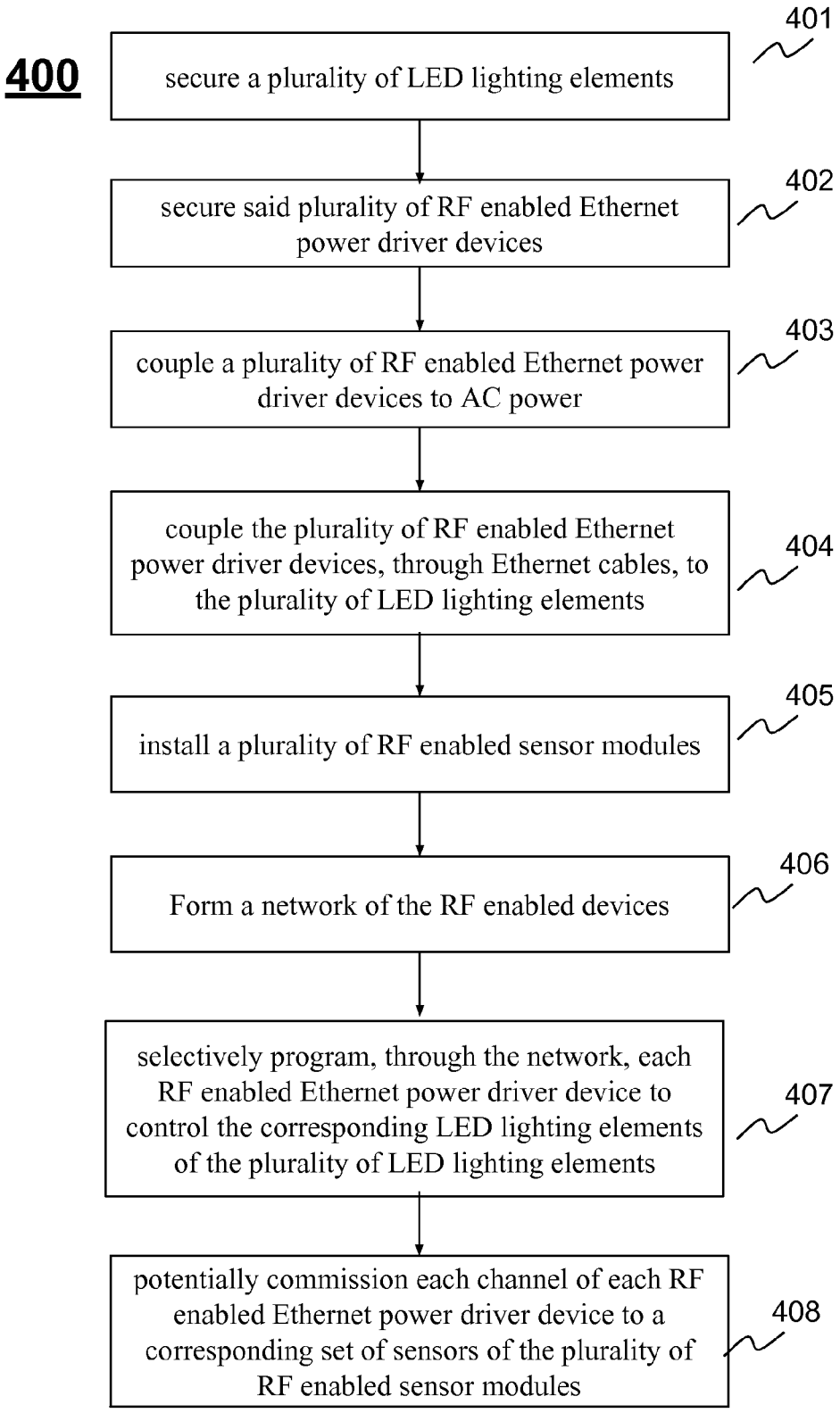
FIGS. 4 illustrates a method of installing a lighting system according to one embodiment of the invention.

FIGS. 4 illustrates a method 400 of installing a lighting system according to one embodiment of the invention. The method includes securing, coupling, forming a network, and selectively programming.

At 401, secure a plurality of LED lighting elements. There lighting elements may be fixed within a number of lighting fixtures. Each fixture may have one or more Ethernet connectors.

At 402, secure said plurality of RF enabled Ethernet power driver devices. The devices may be secured in a matrix such that the coupling to AC power is done above the ceiling and with a minimum number of AC lines.

At 403, couple a plurality of RF enabled Ethernet power driver devices to alternating current (AC) power. The coupling may require an AC line for one or more RF enabled Ethernet power driver devices. These RF enabled Ethernet power driver devices may be situated above a drop ceiling. The coupling may be done when other AC lines are being run by an electrician.

At 404, couple the plurality of RF enabled Ethernet power driver devices, through Ethernet cables, to the plurality of LED lighting elements. The coupling may be accomplished by proximity without regard to which cables are connected to which lighting fixtures. A commissioning of the lighting system may take care of configuring the particular channels of the RF enabled Ethernet power driver devices and as well as the sensors of the RF enabled sensors.

At 405, install a plurality of RF enabled sensor modules. Each RF enabled sensor module provides information regarding its proximate physical zone. In one embodiment, the RF enabled sensor modules include multiple sensors. These multiple sensors may be more than one intensity sensor, a motion sensor, or pressure sensors. A sensor that senses someone sitting in a chair may be used.

At 406, Form a network of the RF enabled devices. The network may use firmware integrated into each power driver device of the plurality of RF enabled Ethernet power driver devices. The firmware may have memory to store the assignment and identification of each channel of drivers. Firmware may also be used in the RF enabled sensor modules.

At 407, selectively program, through the network, each RF enabled Ethernet power driver device to control the corresponding LED lighting elements of the plurality of LED lighting elements. In one embodiment each channel of each driver bank associated with each Ethernet cable may be individually programmed.

At 408, potentially commission each channel of each RF enabled Ethernet power driver device to a corresponding set of sensors of the plurality of RF enabled sensor modules. The commissioning may use software enabled by an RF enabled computer. The commissioning may include examining which sensors of the plurality of RF enabled sensor modules respond to which LED lighting elements of the plurality of LED lighting elements using sensor feedback routines. The commissioning may include registering a configuration of proximate RF enabled devices of the network to configure each channel. The commissioning may include selectively validating and/or altering the configuration by a user. wherein The RF enabled computer may be a portable device used for the registering and the selectively validating and/or altering.

In one embodiment, the securing may include orchestrate Ethernet ports of said plurality of RF enabled Ethernet power driver devices accessible below said ceiling thereby reducing the labor needed to install said lighting system.

Figure 5:
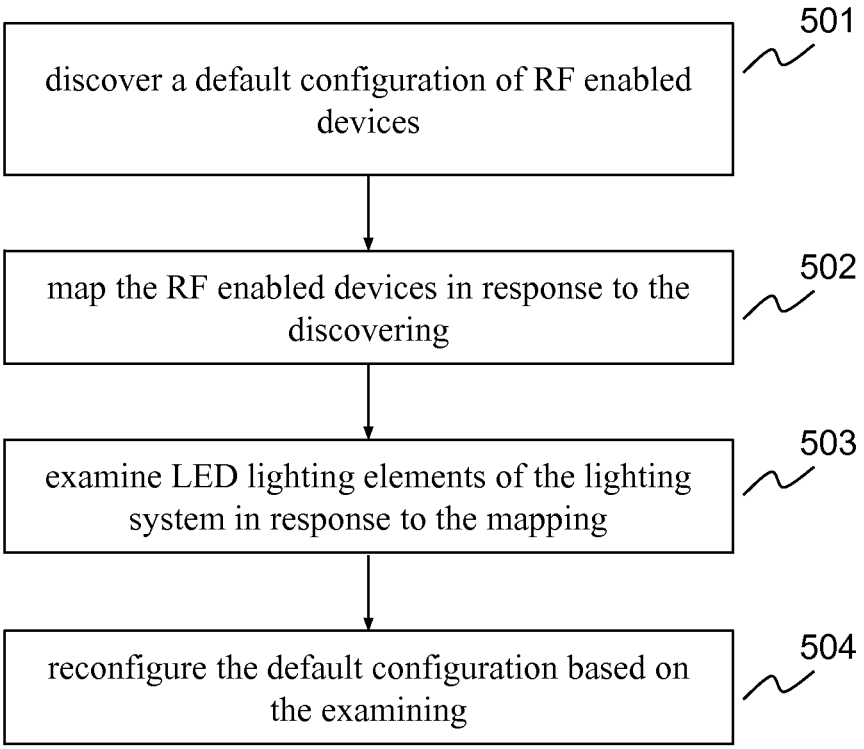
FIGS. 5 illustrates a method of commissioning a lighting system according another embodiment of the invention.

FIGS. 5 illustrates a method 500 of commissioning a lighting system according another embodiment of the invention. The method includes discovering a default configuration, mapping, and examining At 501, discover a default configuration of RF enabled devices of the lighting system by polling proximate RF enabled devices. The RF enabled devices form a wireless network. The network may be a mesh network. Zigby devices are used in such networks.

At 502, map the RF enabled devices in response to the discovering. The means of relaying information lends itself to mapping out the relative locations of the RF enabled devices in the network.

At 503, examine LED lighting elements of the lighting system in response to the mapping. Each LED lighting element is associated with at least two RF enabled devices. In one embodiment a single LED lighting element may be energized and RF enabled sensor modules may be polled to see which light intensity sensors responded to the stimuli. This information may be used to more accurately determine which lights and sensors are proximate and which are located in which rooms.

In one embodiment, the discovering of the configuration includes determining if an RF enabled device is an Ethernet driver or a sensor module. In another embodiment, the discovering of the configuration includes determining the configuration of Ethernet driver ports of RF enabled Ethernet power driver devices. Some RF enabled Ethernet driver devices have differing number of driver ports.

The examining may include testing each Ethernet driver channel against probable RF enabled sensors to determine stimulus information feedback through said wireless network and thereby determine correspondence between each Ethernet driver channel and a set of RF enabled sensors.

At 504, reconfigure the default configuration based on the examining. The reconfiguring includes associating RF enabled devices into groups. In one embodiment, the reconfiguring includes validating and/or altering said default configuration with a RF enabled portable device made proximate to a set of said RF enabled devices being reconfigured.

The above description illustrates various embodiments of the present invention along with examples of how aspects of the present invention may be implemented. The above examples and embodiments should not be deemed to be the only embodiments, and are presented to illustrate the flexibility and advantages of the present invention. Based on the above disclosure, other arrangements, embodiments, implementations and equivalents will be evident to those skilled in the art and may be employed without departing from the spirit and scope of the invention.

What is claimed is:

1. A lighting system comprising:

a plurality of light emitting diode (LED) lighting elements;

a plurality of radio frequency (RF) enabled Ethernet power driver devices coupled to provide power to said plurality of LED lighting elements through Ethernet cables, wherein a power driver device of said plurality of RF enabled Ethernet power driver devices uses integrated firmware to form a network allowing said power driver device to be selectively programmed to control corresponding LED lighting elements of said plurality of LED lighting element;

a plurality of RF enabled sensor modules which form additional nodes in said network, wherein a RF enabled sensor module provides information regarding its proximate physical zone; and software enabled by an RF enabled computer to potentially commission a channel of said RF enabled Ethernet power driver to a corresponding a sensor module of said plurality of RF enabled sensor modules, wherein said commissioning includes sensor feedback routines which examine which sensors of said plurality of RF enabled sensor modules respond to which LED lighting elements of said plurality of LED lighting elements.

2. The lighting system of claim 1 wherein said information includes light intensity information.

3. The lighting system of claim 1 wherein said information includes information regarding physical human activity.

4. A lighting system comprising:

a plurality of light emitting diode (LED) lighting elements;

a plurality of radio frequency (RF) enabled Ethernet power driver devices coupled to provide power to said plurality of LED lighting elements through Ethernet cables, wherein a power driver device of said plurality of RF enabled Ethernet power driver devices uses integrated firmware to form a network allowing said power driver device to be selectively programmed to control corresponding LED lighting elements of said plurality of LED lighting elements, a plurality of RF enabled sensor modules which form additional nodes in said network, wherein a RF enabled sensor module provides information regarding its proximate physical zone; and software enabled by an RF enabled computer to potentially commission a channel of said RF enabled Ethernet power driver to a corresponding set of sensor modules of said plurality of RF enabled sensor modules, wherein said RF enabled computer is a portable device and said software includes routines to commission said channel by registering a configuration of proximate RF enabled devices of said network and allowing a user to validate and/or alter said configuration.

5. The lighting system of claim 4 wherein said information includes light intensity information.

6. The lighting system of claim 4 wherein said information includes information regarding physical human activity.

7. A method of installing a lighting system comprising:

securing a plurality of LED lighting elements;

coupling a plurality of RF enabled Ethernet power driver devices to alternating current (AC) power;

coupling said plurality of RF enabled Ethernet power driver devices, through Ethernet cables, to said plurality of LED lighting elements;

forming a network using firmware integrated into a power driver device of said plurality of RF enabled Ethernet power driver devices;

selectively programming, through said network, said power driver device to control said corresponding LED lighting elements of said plurality of LED lighting elements securing said plurality of RF enabled Ethernet power driver devices in a matrix such that said coupling to AC power is done above the ceiling and with a minimum number of AC line drops such that a professional electrician's work is minimalized.

8. The method of claim 7 further comprising:

installing a plurality of RF enabled sensor modules which form additional nodes in said network, wherein a RF enabled sensor module of said plurality of RF enabled sensor modules provides information regarding its proximate physical zone.

9. The method of claim 8 further comprising potentially commissioning a channel of said plurality RF enabled Ethernet power driver devices to a corresponding sensor of said plurality of RF enabled sensor modules, wherein said commissioning uses software enabled by an RF enabled computer.

10. The method of claim 9 wherein said commissioning further includes examining which sensors of the plurality of RF enabled sensor modules respond to which LED lighting elements of said plurality of LED lighting elements using sensor feedback routines.

11. The method of claim 9 wherein said commissioning includes registering a configuration of proximate RF enabled devices of said network to commission said channel, and selectively validating and/or altering said configuration by a user, wherein said RF enabled computer is a portable device used for said registering and said selectively validating and/or altering.

12. The method of claim 7 further comprising orchestrating Ethernet ports of said plurality of RF enabled Ethernet power driver devices accessible below said ceiling thereby reducing the labor needed to install said lighting system.

13. A method of commissioning a lighting system comprising:

discovering a default configuration of RF enabled devices of said lighting system by polling proximate RF enabled devices, said RF enabled devices forming a wireless network;

mapping said RF enabled devices in response to said discovering; and examining LED lighting elements of said lighting system in response to said mapping, wherein each of said LED lighting elements is associated with at least two RF enabled devices.

14. The method of claim 13 wherein said discovering the configuration includes determining if an RF enabled device is an Ethernet driver or a sensor module.

15. The method of claim 13 wherein discovering the configuration includes determining the configuration of Ethernet driver ports of RF enabled Ethernet power driver devices.

16. The method of claim 15 wherein examining includes testing each Ethernet driver channel against probable RF enabled sensors to determine stimulus information feedback through said wireless network and thereby determine correspondence between each Ethernet driver channel and a set of RF enabled sensors.

17. The method of claim 13 further comprising reconfiguring said default configuration based on said examining, wherein reconfiguring includes associating RF enabled devices into groups.

18. The method of claim 17 wherein reconfiguring includes validating and/or altering said default configuration with a RF enabled portable device made proximate to a set of said RF enabled devices being reconfigured.

19. A method of installing a lighting system comprising:

securing a plurality of LED lighting elements, coupling a plurality of RF enabled Ethernet power driver devices to alternating current (AC) power;

coupling said plurality of RF enabled Ethernet power driver devices, through Ethernet cables, to said plurality of LED lighting elements, forming a network using firmware integrated into a power driver device of said plurality of RF enabled Ethernet power driver devices selectively programming, through said network, said power driver device to control said corresponding LED lighting elements of said plurality of LED lighting elements installing a plurality of RF enabled sensor modules which form additional nodes in said network, wherein a RF enabled sensor module of said plurality of RF enabled sensor modules provides information regarding its proximate physical zone potentially commissioning a channel of said each RF enabled Ethernet power driver device to a corresponding sensor of said plurality of RF enabled sensor modules, wherein said commissioning uses software enabled by an RF enabled computer, and wherein said commissioning further includes examining which sensors of the plurality of RF enabled sensor modules respond to which LED lighting elements of said plurality of LED lighting elements using sensor feedback routines.

20. A method of installing a lighting system comprising:

securing a plurality of LED lighting elements, coupling a plurality of RF enabled Ethernet power driver devices to alternating current (AC) power;

coupling said plurality of RF enabled Ethernet power driver devices, through Ethernet cables, to said plurality of LED lighting elements, forming a network using firmware integrated into a power driver device of said plurality of RF enabled Ethernet power driver devices selectively programming, through said network, said power driver device to control said corresponding LED lighting elements of said plurality of LED lighting elements installing a plurality of RF enabled sensor modules which form additional nodes in said network, wherein a RF enabled sensor module of said plurality of RF enabled sensor modules provides information regarding its proximate physical zone potentially commissioning a channel of said each RF enabled Ethernet power driver device to a corresponding sensor of said plurality of RF enabled sensor modules, wherein said commissioning uses software enabled by an RF enabled computer, and wherein said commissioning includes registering a configuration of proximate RF enabled devices of said network to commission said channel, and selectively validating and/or altering said configuration by a user, wherein said RF enabled computer is a portable device used for said registering and said selectively validating and/or altering.

* * * * *